US005242343A

United States Patent [19]

Miller

[11] Patent Number: 5,242,343

[45] Date of Patent: Sep. 7, 1993

[54] STATIONARY EXERCISE DEVICE

[76] Inventor: Larry Miller, 1628 Treeside Dr., Rochester, Mich. 48307

[21] Appl. No.: 953,897

[22] Filed: Sep. 30, 1992

[51] Int. Cl.[5] ..... A63B 69/16; A63B 22/04

[52] U.S. Cl. ..... 482/57; 482/51; 482/52

[58] Field of Search ..... 482/51, 52, 57, 70, 482/58, 110, 53

[56] References Cited

U.S. PATENT DOCUMENTS

| | | | |
|---|---|---|---|
| 219,439 | 9/1879 | Blend . | |
| 2,603,486 | 7/1952 | Huges | 272/79 |
| 3,316,898 | 5/1967 | Brown | 482/51 |
| 3,759,511 | 9/1973 | Zinkin et al. | 272/58 |
| 4,509,742 | 4/1985 | Cones | 272/73 |
| 4,645,200 | 2/1987 | Hix | 272/73 |
| 4,720,093 | 1/1988 | Del Mar | 272/70 |
| 4,869,494 | 9/1989 | Lambert | 272/73 |
| 4,949,954 | 8/1990 | Hix | 272/73 |
| 5,039,088 | 8/1991 | Shifferaw | 272/73 |

FOREIGN PATENT DOCUMENTS

| | | | |
|---|---|---|---|
| 2919494 | 11/1980 | Fed. Rep. of Germany | 482/57 |

*Primary Examiner*—Stephen R. Crow

*Attorney, Agent, or Firm*—Krass & Young

[57] ABSTRACT

An exercise device includes a pair of foot engaging links. The first end of each link is supported for rotational motion about a pivot axis and a second end of each foot link is guided in a reciprocal path of travel. The combination of these foot link motions permits the users foot to travel in an inclined, oval path of travel. This natural foot action exercises a large number of muscles through a wide range of motion.

9 Claims, 4 Drawing Sheets

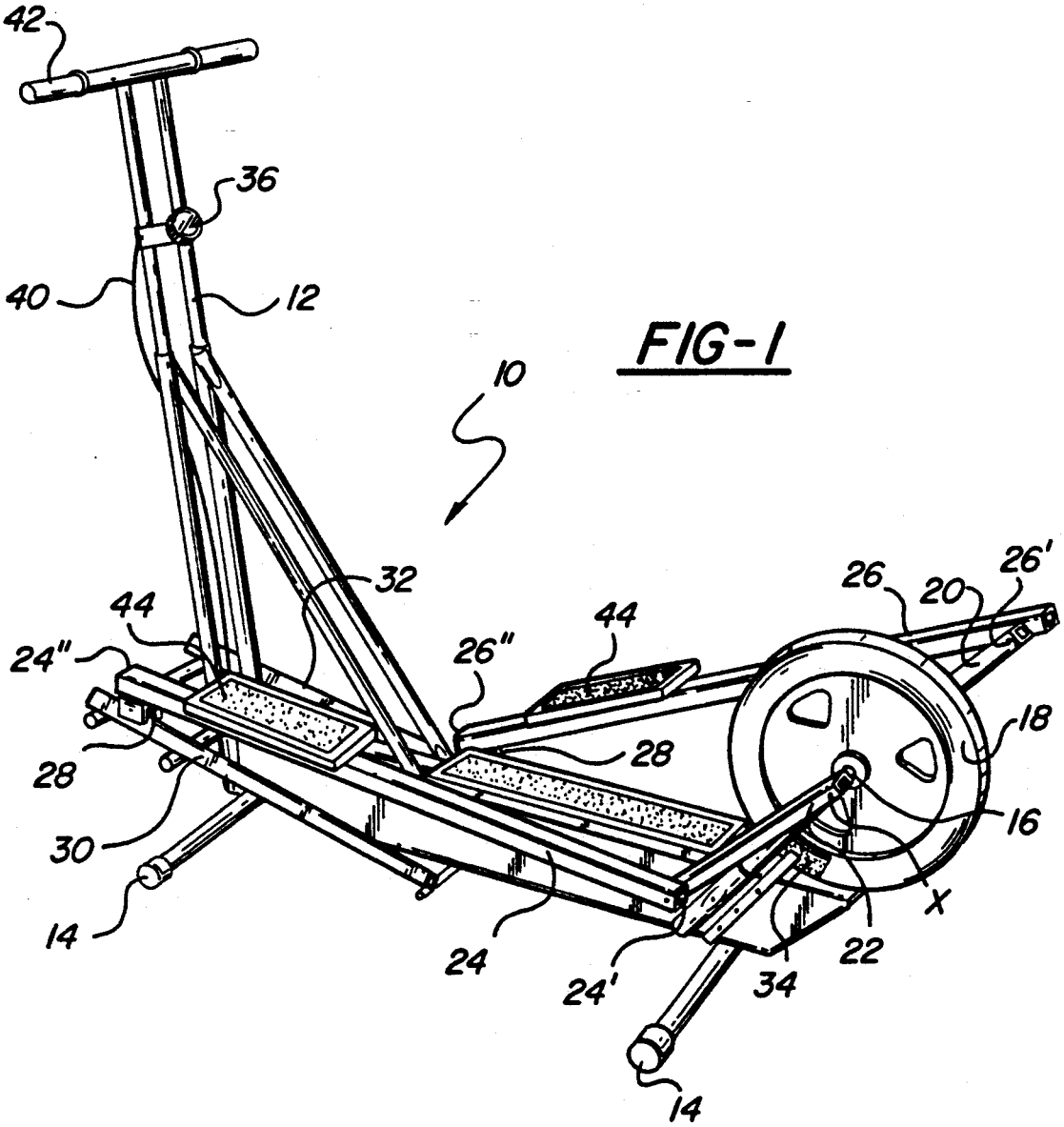
FIG-1
FIG-2A
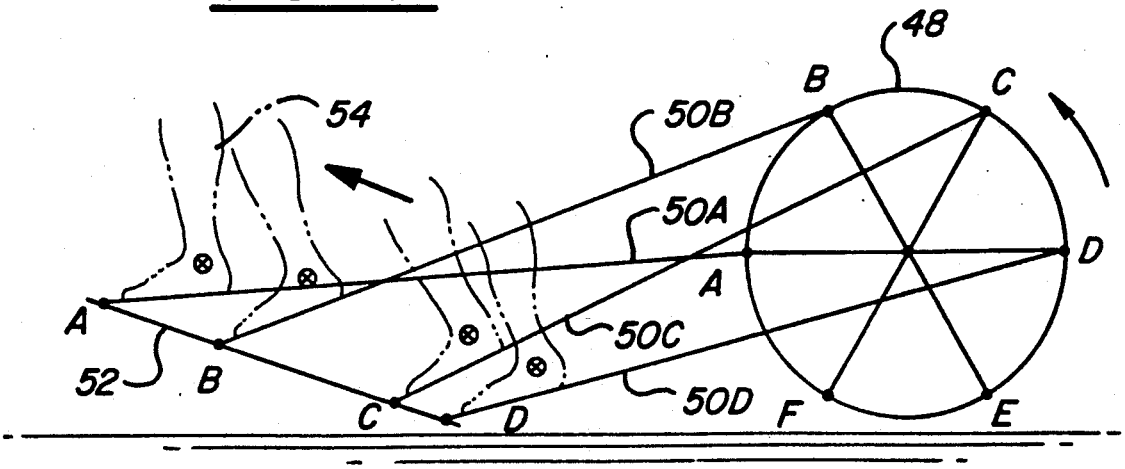

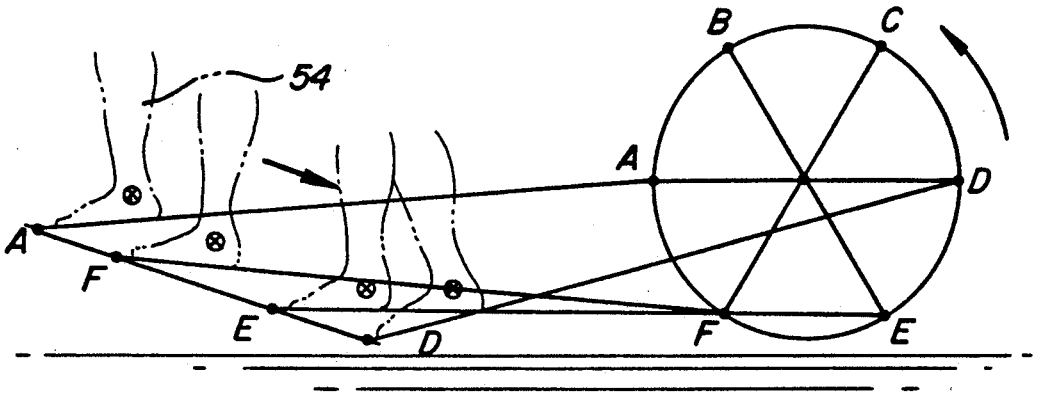
FIG-2B
FIG-2C
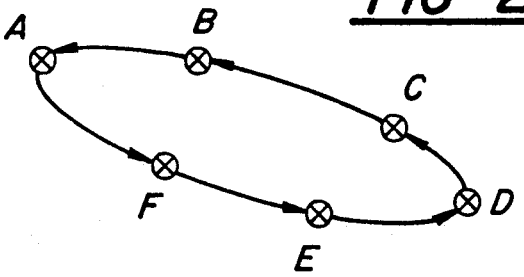
FIG-3
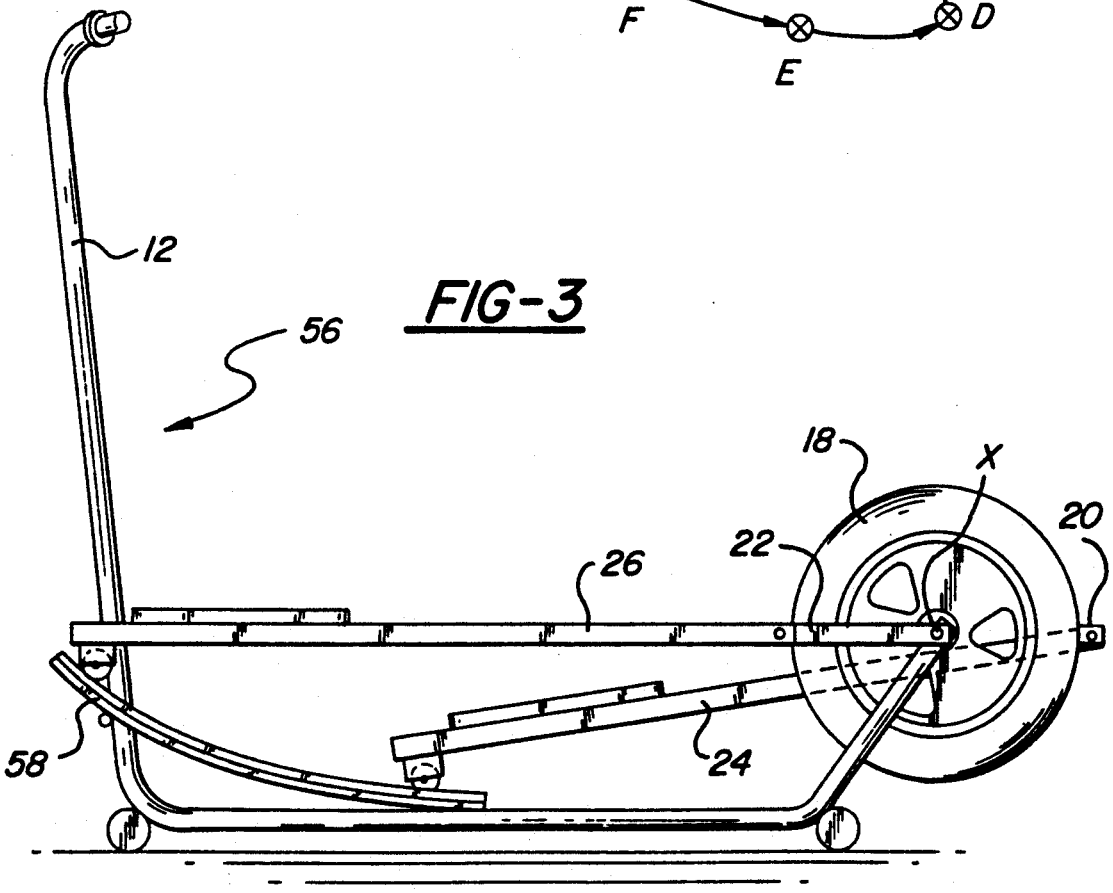

STATIONARY EXERCISE DEVICE

FIELD OF THE INVENTION

This invention relates generally to exercise equipment. More specifically, the invention relates to a stationary exercise device for simulating running and stepping motions.

BACKGROUND OF THE INVENTION

Because of a growing appreciation for the benefits of regular exercise; and because constraints of time and space prevent many persons from indulging in activities such as running, swimming and walking, the market for exercise equipment is rapidly increasing. It is generally desirable to exercise a number of different muscles over a fairly large range of motion so as to provide for even physical development and a maximum level of aerobic exercise. It is further desirable that exercise equipment provide a smooth, relatively natural motion so as to avoid jarring or irregular strains which can damage muscles and joints. It is also desirable that exercise equipment be relatively easy to use and of simple, low cost construction.

While a number of different exercise systems are known in the prior art, such systems suffer from a number of shortcomings which limit their utility. Stationary bicycles are widely used; however, they are employed in a sitting position and consequently, the number of muscles exercised is small. Furthermore, the range of motion provided by a stationary bicycle is fairly limited. Stationary devices for simulating cross country skiing are also in widespread use. While these systems exercise more muscles than do stationary bicycles, the relatively flat, shuffling foot motion provided thereby does not adequately exercise all of the leg muscles through a wide range of motion. Stair climbing equipment also exercises more muscles than do stationary bicycles; however, the rather limited up and down motion provided thereby does not exercise leg muscles through a large range of motion. Treadmills and the like permit walking or jogging in a relatively limited area; however, they can be quite jarring to knee and ankle joints, and many users find it difficult to maintain balance on a treadmill.

U.S. Pat. No. 4,720,093 shows a climbing type exerciser. U.S. Pat. No. 4,509,742 shows a stationary bicycle which provides for arm motion. U.S. Pat. No. 2,603,486 shows a bicycle type exerciser providing for combining arm and leg motions. U.S. Pat. No. 5,039,088 shows another bicycle type exerciser providing for hand motion.

Despite the large number of exercise devices known in the prior art there is still a need for an exercise device which is simple to manufacture and use and which provides for a smooth, natural action and which exercises a relatively large number of muscles through a large range of motion. The exercise device of the present invention, as will be described herein below, provides for a smooth stepping—running motion which exercises a user's legs more fully than cycling or skiing devices. The device of the present invention may also be employed to provide arm and shoulder motions. The smooth action of the device prevents trauma to joints and muscles.

These and other advantages of the present invention will be readily apparent from the drawings, discussion and description which follow.

BRIEF DESCRIPTION OF THE INVENTION

There is disclosed herein an exercise device which comprises a frame having a fixed pivot axis defined thereon. The device includes a first and second foot link each having a first and a second end. The device includes a coupling member associated with the first end of each foot link for pivotally coupling the first end to the pivot axis at a predetermined distance therefrom so that the first end of each foot link travels in an arcuate path of travel about the pivot axis. The device also includes a first and second guide member, each operable to engage the second end of a respective one of the foot links and to direct the second end along a preselected, reciprocating path of travel as the first end of the link travels along the arcuate path. In particular embodiments, the coupling member may comprise a bell crank or a flywheel employed either singly or in combination. The device may include braking means for increasing drag of the system to thereby increase the level of exercise required. The guide member may comprise a track which engages and directs the foot links, or it may comprise a pair of arms which are pivotally attached to the frame and to the second end of each foot link so as to permit the ends of the foot links to swing along in said reciprocal path of travel.

BRIEF DESCRIPTION OF THE DRAWINGS

FIG. 1 is a perspective view of a first embodiment of the exercise device structured in accord with the principles of the present invention;

FIG. 2*a* is a schematic depiction of the path of travel of a user's foot during the forward and upward portion of the operational cycle of the apparatus of the present invention;

FIG. 2*b* is a schematic depiction of the rearward and downward path of travel of the user's foot in the operational cycle of the present invention;

FIG. 2*c* is an illustration of the oval path of travel transversed by the foot of a person using the exercise device of the present invention;

FIG. 3 is a side elevational view of another embodiment of a the apparatus structured in accord with the principles of the present invention;

DETAILED DESCRIPTION OF THE INVENTION

Figure 4:
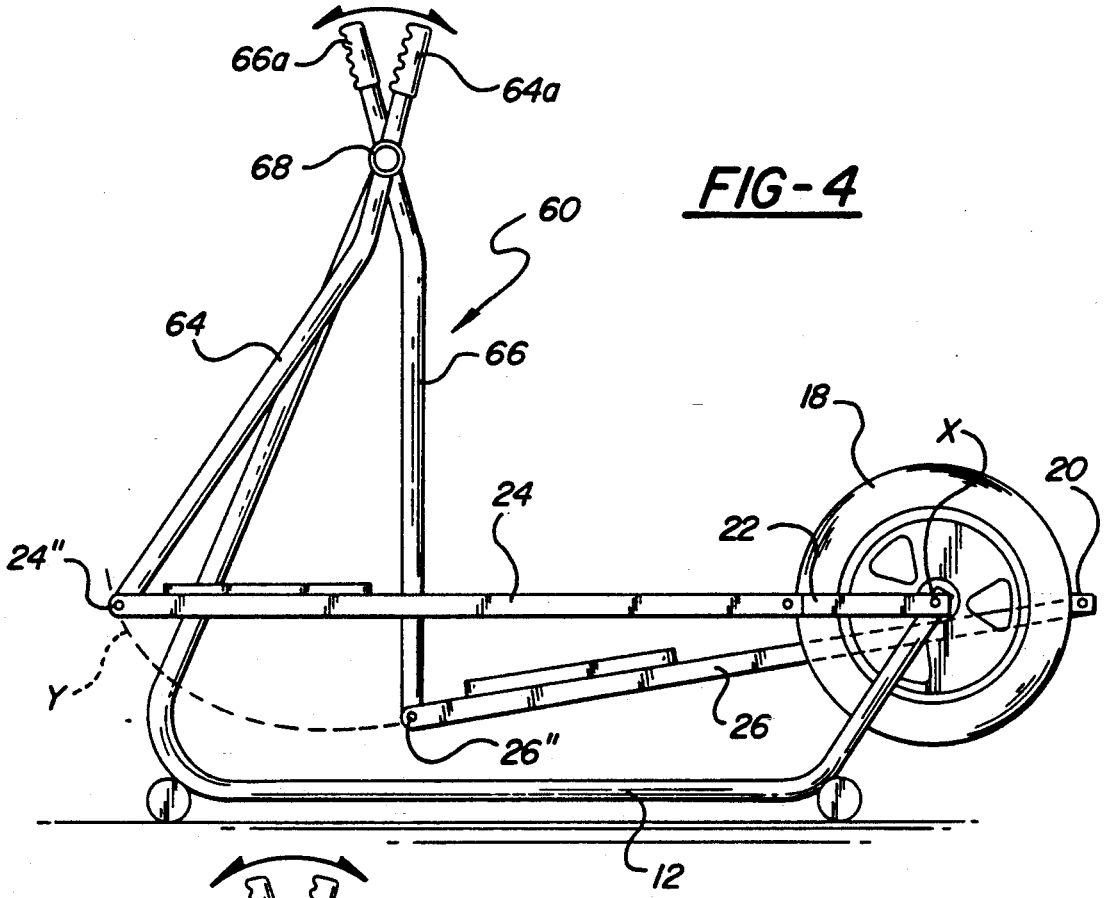
FIG. 4 is a side elevational view of yet another embodiment of the present invention.

Referring now to FIG. 1, there is shown a first embodiment of an exercise device structured in accord with the principles of the present invention. The exerciser includes a frame 12 having a pair of legs 14 disposed to support the frame 12 on a floor or other such surface. The frame 12 has a pivot axis, X, defined therein, as for example by a shaft 16 passing through, and supported by the frame 12.

In the illustrated embodiment, the shaft 16 has a flywheel 18 supported thereupon for rotation about the pivot axis X. The apparatus further includes a first and second bell crank 20, 22 pivotally mounted for rotation about the axis X. The apparatus further includes a first and a second foot links, 24, 26 respectively. The foot links 24, 26 are generally elongated members having a first end 24', 26' respectively, pivotally connected to the coupling member, (in this instance the bell cranks 22,20) in such a manner so as to permit travel of the first ends 24' 26' of the foot links 24 and 26 in an arcuate path of travel about the pivot axis X at a predetermined length corresponding to the length of the bell cranks 20, 22. Within the context of this application, "arcuate" shall refer to a circular oval or other such closed, curved path of travel.

A second end 24'', 26'' of the foot links 24 and 26 respectively terminate in rollers 28 which engage tracks 30, 32. The tracks 30,32 direct the second end 24'', 26'' of the foot links 24, 26 in a reciprocal path of travel as the first ends 24', 26' of the links 24, 26 travel about the pivot axis X. Within the context of the this application, a "reciprocal" path of travel is meant to define any back and forth path of travel which is repetitively traversed by the end of the foot link and includes a generally linear path of travel as is provided by the flat track 28, 32 of the FIG. 1 embodiment as well as curved paths of travel provided by other embodiments shown herein.

The apparatus of the FIG. 1 embodiment may further include a friction brake 34 associated with the flywheel 18 for purposes of imposing drag on the wheel so as to increase the amount of exercise provided by the apparatus 10. The friction brake 34 may be adjusted by an adjustment knob 36 operating through a flexible cable 40 upon the friction pad assembly 34, as is well known to those of skill in the art. Other types of braking device such as a magnetic brake and the like may be similarly employed. In the illustrated embodiment, the frame 12 includes a hand grip 42 mounted on an upright portion of the frame 12. The FIG. 1 embodiment 10 further includes foot retaining pads 44 which preferably comprise pads formed at least partially of a relatively soft, high coefficient of friction material such as rubber.

The interaction of the foot links 24 and 26 with the bell cranks 20 and 22 and with the tracks 28 and 32 provide for a unique and smooth foot motion, as will be explained with reference to FIGS. *2a–c*. Referring now to FIG. *2a*, there is shown a stylized depiction of the apparatus of the present invention in use. Illustrated therein is a wheel 48, showing a foot link 50 having a first end coupled thereto and a second end engaged with a track 52. Rotation of the wheel 48 will reposition the foot link 50 along the track, and as illustrated, the orientation of the track and foot at four locations d, c, b and a, corresponding to the forward and upward motion of the foot, 54 are illustrated. It will be noted that as the position changes from d to a the foot 54 rises and moves forward and that the angle formed at the ankle varies.

Referring now to FIG. *2b*, there is shown the same arrangement of parts depicting the subsequent rearward and downward motion of the foot 54. Again, the angle between the foot and leg varies as the rearward and downward motion takes place. It is notable that the path of travel of the foot 54 is not the same for the forward and reverse motion. FIG. *2c* illustrates the oval path as traversed by the user's foot during the cycle of this apparatus. This compound motion is very smooth and natural; consequently, it avoids jarring as well as simple, repetitive back and fourth motion which can overstress particular muscles while neglecting others. Smooth and pleasing motion provided by this particular mechanical arrangement encourages use of the equipment.

Referring now to FIG. 3, there is shown another embodiment of exercise device 56 structured in accord with the principles of the present invention. The device 56 of FIG. 3 is generally similar to that of FIG. 1, and accordingly like structures will be referred to by like reference numerals.

The exercise device 56 includes a frame 12 and foot links 26 as generally described herein above. The device also includes tracks for guiding the foot links, and one track 58 is visible in this drawing. The tracks of the FIG. 3 embodiment differ from those of FIG. 1 insofar as they are somewhat curved in an upward direction. It has been found that the curve provides for a more gradual rise in the elevation of the foot links. In accord with the present invention, the tracks still guide the foot links 24, 26 in a reciprocal path of travel.

The device 56 of FIG. 3 further differs from that of FIG. 1 insofar as the bell cranks 20,22 are somewhat shorter. In other instances the first end of the foot links 24, 26 are pivotally connected directly to the flywheel which functions to couple the foot link to the pivot axis X to permit rotation thereabout. In such instance, the flywheel is preferably a double wheel supported for rotation about a central axis. It will be appreciated that various mechanical arrangements may be employed to couple the foot links 24, 26 to the pivot axis X and such variations may include a larger flywheel, a smaller flywheel or may eliminate the flywheel entirely provided the foot links are coupled so as to permit an arcuate path of travel of the first end of each foot link about the pivot axis X.

Referring now to FIG. 4 there is shown yet another embodiment of exercise device 60 structured in accord with the principles of the present invention. Again, like elements will be indicated by like reference numerals. The exercise device 60 of the FIG. 4 embodiment differs from the previous embodiments insofar as it does not include a track for guiding the second ends 24'', 26'' of the foot links 24, 26 along the reciprocal path of travel. In this embodiment, the guide member function is provided by a pair of arm links 64 and 66.

Each arm link 64,66 is pivotally supported by the frame 12 at support point 68. The arm links 64,66 are also pivotally coupled to the ends 24'', 26'' of the foot links 24, 26. As indicated by phantom line Y, pivoting of the arm links 64, 66 about the support point 68 causes the second ends 24'', 26'' of the foot links 24, 26 to reciprocate along the curved path Y.

As illustrated in FIG. 4, the arm links 64,66 also include handle portions 64*a*, 66*a* associated therewith. These handle portions may be configured to be gripped by a user and, during the operation of the device they also reciprocate, thereby providing upper body exercise. It will be appreciated that in some embodiments, the handle portions 64*a*, 66*a* may be eliminated. In other instances they may be enlarged, bent or otherwise modified to provide an altered range of motion.

Figure 5:
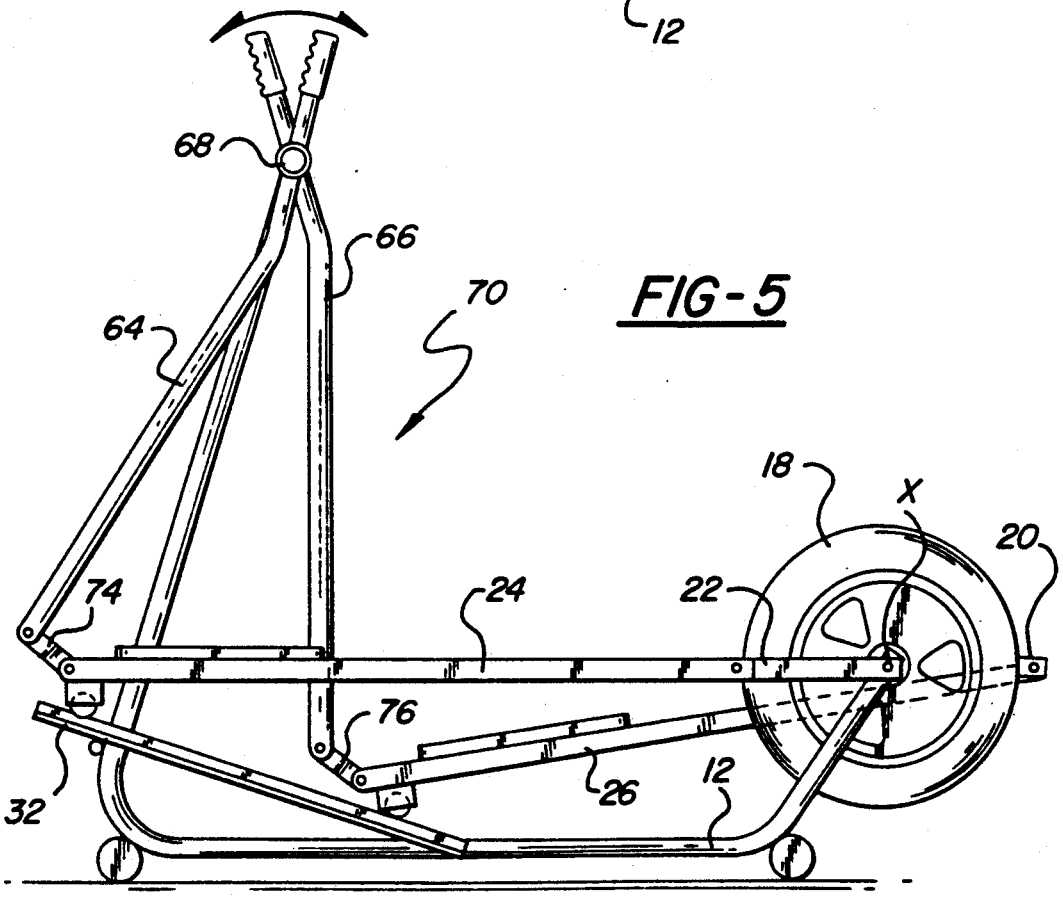
FIG. 5 is a side elevational view of a fourth embodiment of the present invention.

Referring now to FIG. 5 there is shown another embodiment of exercise device 70, structured in accord with the principles of the present invention. The device 70 is generally similar to those previously shown and like structures will be referred to by like reference numerals. The exercise device 70 of FIG. 5 is generally similar to that of FIG. 1 insofar as it includes a frame 12 having a pivot axis X which supports an assembly of foot links 24, 26 and associated bell cranks 20, 22 for rotation thereabout. The embodiment also includes a flywheel 18 and a series of tracks, one of which, 32, is visible in this drawing. As in the FIG. 1 embodiment, the tracks function as guide members for directing the ends of the foot links 24, 26 in a reciprocal path of travel.

The FIG. 5 embodiment 70, also includes a pair of arm links 64, 66 associated with the foot links 24, 26. In this embodiment, in contrast to the FIG. 4 embodiment, the arm links 64,66 do not function as guide members but merely serve to provide upper body exercise. Since the track is straight, the arm links 64,66 are connected to the corresponding foot links 24, 26 by a pair of connecting links 74, 76 in order to accommodate their respective paths of travel. In accord with another variation of the present invention, the track of the FIG. 5 embodiment may be made curved, so as to correspond to the motion of the arm links 64, 66 about the support point 68, and in such instance the connecting links 74, 76 may be eliminated. In this particular embodiment, the arm links 64, 66 will also function, to some degree, to guide the foot links 24, 26.

Figure 6:
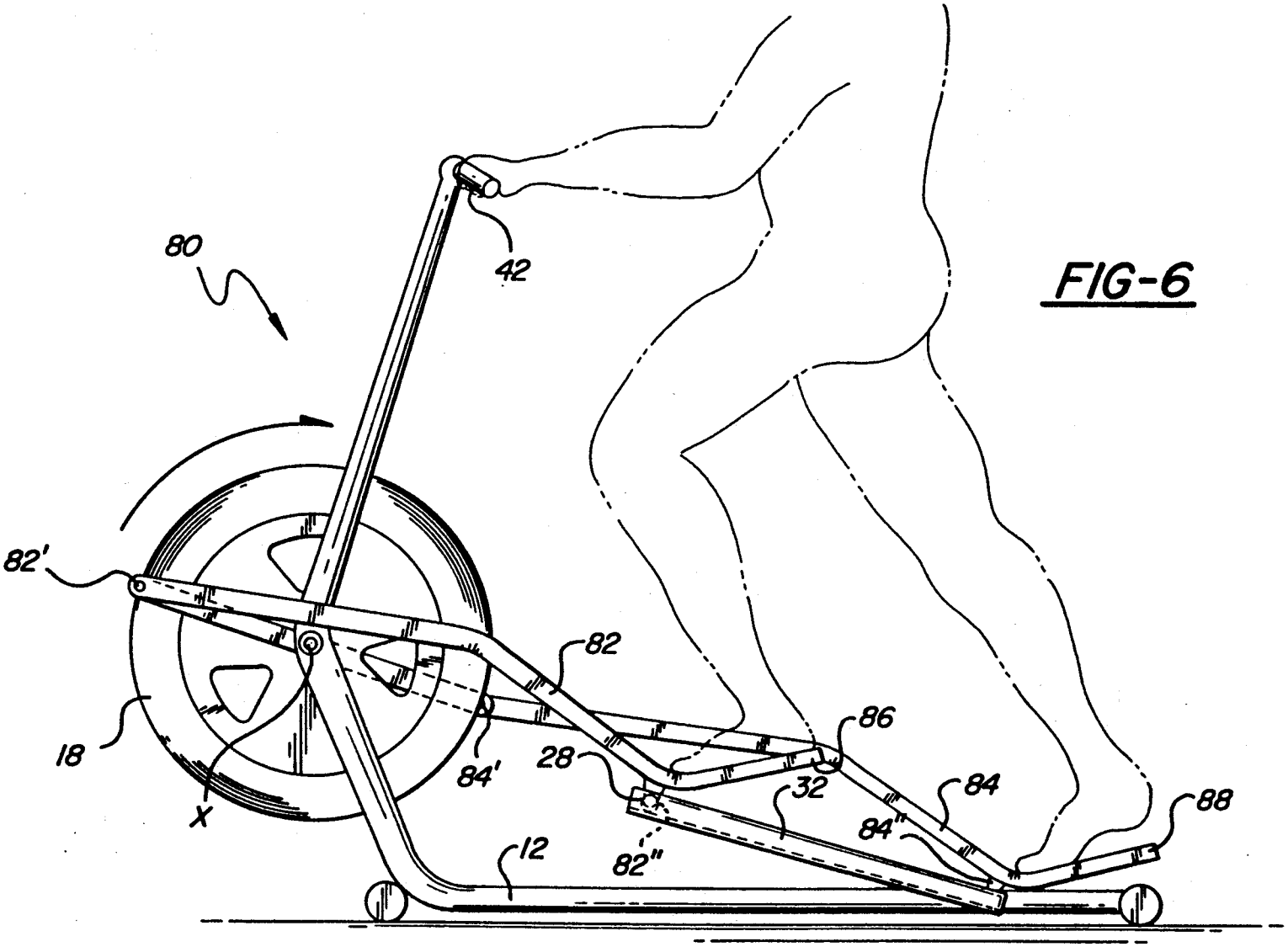
FIG. 6 is another embodiment of the exercise device of the present invention.

Referring now to FIG. 6, there is shown yet another embodiment of an exercise device structured in accord with the principles of the present invention. The device 80 of FIG. 6 is generally similar in construction and operation to the preceding embodiments; however, the location of the flywheel 18 and track, 32 are reversed with regard to the position of the user.

As in the preceding embodiment, the exercise device 80 includes a frame 12 having a pivot axis X defined thereon. A flywheel 18 is supported for rotation about the pivot axis and the device 80 further includes a pair of foot links 82,84, each of which has a first end 82', 84' pivotally affixed to the flywheel 18, so that they travel in an arcuate path about the pivot axis X. The foot links also include second ends 82", 84" which engage tracks. As illustrated, end 82" engages track 32 via a roller 28.

The placement of the foot engaging portion of the foot links 82, 84 differs in the FIG. 6 embodiment from that of the preceding embodiments. The FIG. 6 embodiment includes foot pads 86, 88 which are disposed so as to project from the ends 82" 84" of the foot links 82, 84. It will also be noted that in this embodiment, the foot links are somewhat bent. Finally, the device 80 includes a handle grip portion 42 as in various other preceding embodiments.

Other modifications and variations of the FIG. 6 embodiment are possible within the scope of the present invention. As illustrated, the foot links 82, 84 are coupled to the flywheel by bell cranks 20,22 which pass to the interior of the frame 12. The cranks may pass to the outside of the frame as in the FIG. 1 embodiment. As previously noted, the flywheel and/or bell cranks may be eliminated in some instances.

The principles of the present invention may be adapted to the construction of a variety of other embodiments. As already noted, the size and location of the flywheel may be varied and in some instances, the flywheel may be eliminated or replaced by a series of pulleys or similar structures. The shape and position of the guide members may be similarly varied and auxiliary structures such as braking devices, speedometers, odometers and the like may be incorporated in the device. Accordingly, it will be appreciated that the foregoing drawings, discussion and description are merely meant to illustrate particular embodiments of the invention and are not meant to be limitations upon the practice thereof. It is the following claims, including all equivalents, which define the scope of the invention.

I claim:

1. An exercise device comprising:

a frame having a fixed pivot axis defined thereon, said frame configured to be supported on a floor;

a first and a second foot link, each foot link including a first end, a second end and a foot engaging portion therebetween, said foot engaging portion being configured so that when the exercise device is in use, a user's foot is disposed with a heel portion thereof closest to the first end of said foot link and a toe portion closest to the second end of said foot link;

a coupling member associated with the first end of each foot link for pivotally coupling said fist end to said pivot axis at a predetermined distance therefrom so that said first end travels in an arcuate path about said axis;

a first and a second track, each track supported by said frame in an inclined relationship with the floor, and each track being operative to engage the second end of a respective one of said foot links and to direct said second end along a preselected, reciprocating path of travel as the first end of said foot link travels along said arcuate path so that when said exercise device is in use, and when the second end of one of said foot links travels along said reciprocating path of travel in a direction away from said pivot axis, the heel portion of a user's foot associated therewith initially rises at a faster rate than the toe portion, and when the second end of said foot link travels along said reciprocating path of travel in a direction toward said pivot axis, the heel portion of the user's foot initially lowers at a faster rate than the toe portion.

2. An exercise device as in claim 1, wherein said coupling member comprises a first and a second bell crank each having a first end operative to pivotally engage a first end of a respective one of said foot links and a second end pivotally affixed to said pivot axis.

3. An exercise device as in claim 1, further including a wheel disposed for rotation about said fixed pivot axis.

4. An exercise device as in claim 3, wherein said wheel comprises said coupling member and said first end of each foot link is pivotally affixed to said wheel.

5. An exercise device as in claim 3, wherein said coupling member comprises a first and a second bell crank disposed so as to rotate with said wheel, a first end of each bell crank being pivotally connected to a first end of a respective one of said first and second foot links.

6. An exercise device as in claim 1, further including a braking mechanism operative to impose a drag upon said foot links as the first ends thereof travel in said arcuate path.

7. An exercise device as in claim 1, wherein the first ends of said first and second foot links each include a roller disposed so as to engage a respective one of said tracks.

8. An exercise device as in claim 1, wherein said tracks are straight tracks.

9. An exercise device comprising:

a frame having a front end and a back end, with a pivot axis defined at said back end, said frame configured to be supported upon a floor in a generally horizontal orientation so that said pivot axis is horizontal to said floor;

a first and a second bell crank disposed so as to rotate about said pivot axis;

a first and a second foot link, each foot link including a first end and a second end, each of said first ends pivotally coupled to a respective one of said bell cranks so that said first ends travel in an arcuate path about said pivot axis as said bell cranks rotate about said pivot axis;

each foot link including a foot engaging portion which is disposed between said first and second ends and is configured to receive a user's foot so that a heel portion thereof is nearest the first end of the foot link and a toe portion is nearest the second end thereof;

a first and second track supported by the front end of said frame in an inclined relationship with the floor, each track being operative to engage and guide the second end of a respective one of said foot links along a respective, back and forth path of travel as the first end thereof travels in said arcuate path.

* * * * *

UNITED STATES PATENT AND TRADEMARK OFFICE

CERTIFICATE OF CORRECTION

PATENT NO. : 5,242,343
DATED : September 7, 1993
INVENTOR(S) : Larry D. Miller

It is certified that error appears in the above-indentified patent and that said Letters Patent is hereby corrected as shown below:

Column 6, line 16 delete "fist" and insert --first--

Column 8, line 9 delete "respective" and insert --repetitive--

Signed and Sealed this

Fourteenth Day of November, 1995

*Attest:*

*Attesting Officer*

BRUCE LEHMAN

*Commissioner of Patents and Trademarks*

US005242343C1

(12) EX PARTE REEXAMINATION CERTIFICATE (5224th)

United States Patent
Miller

(10) Number: US 5,242,343 C1
(45) Certificate Issued: Nov. 1, 2005

(54) STATIONARY EXERCISE DEVICE

(75) Inventor: Larry Miller, Rochester, MI (US)

(73) Assignee: General Electric Capital Corporation, Chicago, IL (US)

Reexamination Request:
No. 90/004,998, May 15, 1998
No. 90/005,560, Nov. 12, 1999

Reexamination Certificate for:

| | |
|---|---|
| Patent No.: | **5,242,343** |
| Issued: | **Sep. 7, 1993** |
| Appl. No.: | **07/953,897** |
| Filed: | **Sep. 30, 1992** |

Certificate of Correction issued Nov. 14, 1995.

(51) Int. Cl.[7] ..... A63B 69/16; A63B 22/04
(52) U.S. Cl. ..... 482/57; 482/51; 482/52
(58) Field of Search ..... 482/51–53, 57, 482/70, 58, 110

(56) References Cited

U.S. PATENT DOCUMENTS

| | | | |
|---|---|---|---|
| 1,273,906 | A | 7/1918 | Nickey |
| 3,432,164 | A | 3/1969 | Deeks |
| 3,713,438 | A | 1/1973 | Knutsen |
| 4,185,622 | A | 1/1980 | Swenson |
| 4,786,050 | A | 11/1988 | Geschwender |
| 5,039,088 | A | 8/1991 | Shifferaw |
| D330,236 | S | 10/1992 | Jarriel et al. |
| 5,279,529 | A | 1/1994 | Eschenbach |

*Primary Examiner*—Stephen R. Crow

(57) ABSTRACT

An exercise device includes a pair of foot engaging links. The first end of each link is supported for rotational motion about a pivot axis and a second end of each foot link is guided in a reciprocal path of travel. The combination of these foot link motions permits the users foot to travel in an inclined, oval path of travel. This natural foot action exercises a large number of muscles through a wide range of motion.

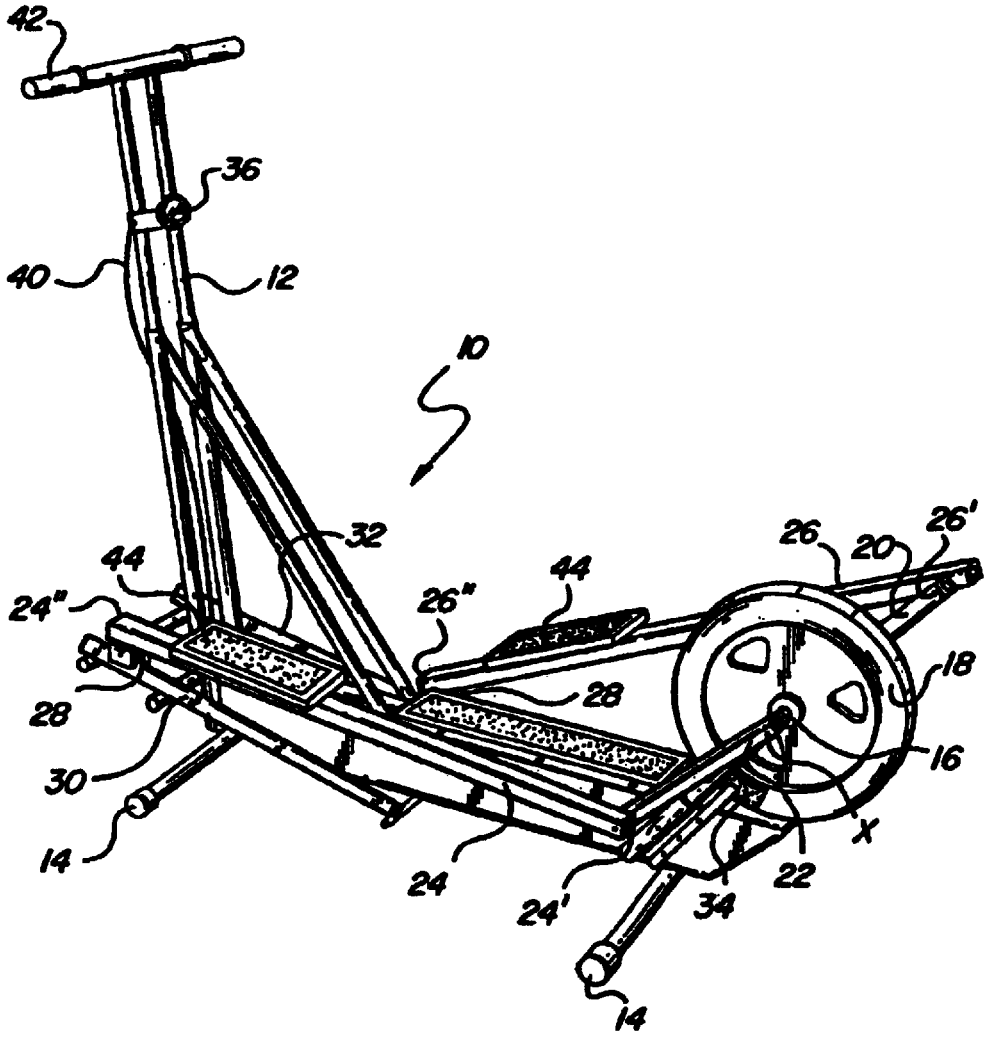

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 1 is confirmed.

Claims 2, 3 and 6–9 are determined to be patentable as amended.

Claims 4 and 5, dependent on an amended claim, are determined to be patentable.

New claims 10–15 are added and determined to be patentable.

2. An exercise device as in claim [1] *12*, wherein said coupling member comprises a first and a second bell crank each having a first end operative to pivotally engage a first end of a respective one of said foot links and a second end pivotally affixed to said pivot axis.

3. An exercise device as in claim [1] *12*, further including a wheel disposed for rotation about said fixed pivot axis.

6. An exercise device as in claim [1] *12*, further including a braking mechanism operative to impose a drag upon said foot links as the first ends thereof travel in said arcuate path.

7. An exercise device as in claim [1] *12*, wherein the first ends of said first and second foot links each include a roller disposed so as to engage a respective one of said tracks.

8. An exercise device as in claim [1] *12*, wherein said tracks are straight tracks.

9. An exercise device comprising:

a frame having a front end and a back end, with a pivot axis defined at said back end, said frame configured to be supported upon a floor in a generally horizontal orientation so that said pivot axis is horizontal to said floor;

a first and a second bell crank disposed so as to rotate about said pivot axis;

a first and a second foot link, each foot link including a first end and a second end, each of said first ends *being* pivotally coupled to a respective one of said bell cranks so that said first ends travel in an arcuate path about said pivot axis as said bell cranks rotate about said pivot axis;

each foot link including a foot engaging portion which is disposed between said first and second ends and is configured to receive a user's foot so that a heel portion thereof is nearest the first end of the foot link and a toe portion is nearest the second end thereof;

a first and second track supported by the front end of said frame in an inclined relationship with the floor, each track being operative to engage and guide the second end of a respective one of said foot links along a repetitive, back and forth path of travel as the first end thereof travels in said arcuate path *so that when said exercise device is in use, and when the second end of one of said foot links travels along said reciprocating path of travel in a direction away from said pivot axis, the heel portion of a user's foot associated therewith initially rises at a faster rate than the toe portion, and when the second end of said foot link travels along said reciprocating path of travel in a direction toward said pivot axis, the heel portion of the user's foot initially lowers at a faster rate than the toe portion.*

*10. An exercise device comprising:*

*a frame having a fixed pivot axis defined thereon, said frame configured to be supported on a floor;*

*a first and a second foot link, each foot link including a first end, a second end and a foot engaging portion therebetween, said foot engaging portion being configured so that when the exercise device is in use, a user's foot is disposed with a heel portion thereof closest to the first end of said foot link and a toe portion closest to the second end of said foot link;*

*a coupling member associated with the first end of each foot link for pivotally coupling said first end to said pivot axis at a predetermined distance therefrom so that said first end travels in an arcuate path about said axis;*

*a first and a second track, each track supported by said frame in an inclined relationship with the floor, and each track being operative to engage the second end of a respective one of said foot links and to direct said second end along a preselected, reciprocating path of travel as the first end of said foot link travels along said arcuate path so that when said exercise device is in use, and when the second end of one of said foot links travels along said reciprocating path of travel in a direction away from said pivot axis, the heel portion of a user's foot associated therewith initially rises at a faster rate than the toe portion, and when the second end of said foot link travels along said reciprocating path of travel in a direction toward said pivot axis, the heel portion of the user's foot initially lowers at a faster rate than the toe portion, and so that the heel portion of said user's foot travels in a path which does not encompass said pivot axis.*

*11. An exercise device comprising:*

*a frame having a front end and a back end, with a pivot axis defined at said back end, said frame configured to be supported upon a floor in a generally horizontal orientation so that said pivot axis is horizontal to said floor;*

*a first and a second bell crank disposed so as to rotate about said pivot axis;*

*a first and a second foot link, each foot link including a first end and a second end, each of said first ends being pivotally coupled to a respective one of said bell cranks so that said first ends travel in an arcuate path about said pivot axis as said bell cranks rotate about said pivot axis;*

*each foot link including a foot engaging portion which is disposed between said first and second ends and is configured to receive a user's foot so that a heel portion thereof is nearest the first end of the foot link and a toe portion is nearest the second end thereof, each foot engaging portion being spaced from the first end of its respective foot link so that when the first end of said foot link travels in said arcuate path, the heel portion of said user's foot travels in a path which does not encompass said pivot axis;*

*first and second track supported by the front end of said frame in an inclined relationship with the floor, each track being operative to engage and guide the second end of a respective one of said foot links along a respective, back and forth path of travel as the first end thereof travels in said arcuate path.*

*12. An exercise device comprising:*

*a frame having a fixed pivot axis defined thereon, said frame configured to be supported on a floor;*

*a first and a second foot link, each foot link including a first end, a second end and a foot engaging portion therebetween, said foot engaging portion being configured so that when the exercise device is in use, a user's foot is disposed with a heel portion thereof closest to the first end of said foot link and a toe portion closest to the second end of said foot link;*

*a coupling member associated with the first end of each foot link for pivotally coupling said first end to said pivot axis at a predetermined distance therefrom so that said first end travels in an arcuate path about said axis;*

*a first and a second track, each track being supported by said frame in an inclined relationship with the floor, and each track being operative to engage the second end of a respective one of said foot links and to direct said second end along a preselected, reciprocating path of travel as the first end of said foot link travels along said arcuate path so that when said exercise device is in use, and when the second end of one of said foot links travels along said reciprocating path of travel in a direction away from said pivot axis, the heel portion of a user's foot associated therewith initially rises at a faster rate than the toe portion, and when the second end of said foot link travels along said reciprocating path of travel in a direction toward said pivot axis, the heel portion of the user's foot initially lowers at a faster rate than the toe portion, and so that the heel portion of said user's foot travels in a path which does not cross a vertical plane passing through said pivot axis.*

*13. An exercise device comprising:*

*a frame having a front end and a back end, with a pivot axis defined at said back end, said frame configured to be supported upon a floor in a generally horizontal orientation so that said pivot axis is horizontal to said floor;*

*a first and a second bell crank disposed so as to rotate about said pivot axis;*

*a first and a second foot link, each foot link including a first end and a second end, each of said first ends being pivotally coupled to a respective one of said bell cranks so that said first ends travel in an arcuate path about said pivot axis as said bell cranks rotate about said pivot axis;*

*each foot link including a foot engaging portion which is disposed between said first and second ends and is configured to receive a user's foot so that a heel portion thereof is nearest the first end of the foot link and a toe portion is nearest the second end thereof, each foot engaging portion being spaced from the first end of its respective foot link so that when the first end of said foot link travels in said arcuate path, the heel portion of said user's foot travels in a path which does not cross a vertical plane passing through said pivot axis;*

*first and second track supported by the front end of said frame in an inclined relationship with the floor, each track being operative to engage and guide the second end of a respective one of said foot links along a respective, back and forth path of travel as the first end thereof travels in said arcuate path.*

*14. An exercise device comprising:*

*a frame having a fixed pivot axis defined thereon, said frame configured to be supported on a floor;*

*a first and a second foot link, each foot link including a first end, a second end and a foot engaging portion therebetween, said foot engaging portion being configured so that when the exercise device is in use, a user's foot is disposed with a heel portion thereof closest to the first end of said foot link and a toe portion closest to the second end of said foot link;*

*a coupling member associated with the first end of each foot link for pivotally coupling said first end to said pivot axis at a predetermined distance therefrom so that said first end travels in an arcuate path about said axis;*

*a first and a second track, each track being supported by said frame in an inclined relationship with the floor, and each track being operative to engage the second end of a respective one of said foot links and to direct said second end along a preselected, reciprocating path of travel as the first end of said foot link travels along said arcuate path so that when said exercise device is in use, and when the second end of one of said foot links travels along said reciprocating path of travel in a direction away from said pivot axis, the heel portion of a user's foot associated therewith initially rises at a faster rate than the toe portion, and when the second end of said foot link travels along said reciprocating path of travel in a direction toward said pivot axis, the heel portion of the user's foot initially lowers at a faster rate than the toe portion, and so that the ankle of said user's foot travels in a path which is entirely outside of said arcuate path.*

*15. An exercise device comprising:*

*a frame having a front end and a back end, with a pivot axis defined at said back end, said frame configured to be supported upon a floor in a generally horizontal orientation so that said pivot axis is horizontal to said floor;*

*a first and a second bell crank disposed so as to rotate about said pivot axis;*

*a first and a second foot link, each foot link including a first end and a second end, each of said first ends being pivotally coupled to a respective one of said bell cranks so that said first ends travel in an arcuate path about said pivot axis as said bell cranks rotate about said pivot axis;*

*each foot link including a foot engaging portion which is disposed between said first and second ends and is configured to receive a user's foot so that a heel portion thereof is nearest the first end of the foot link and a toe portion is nearest the second end thereof, each foot engaging portion being spaced from the first end of its respective foot link so that when the first end of said foot link travels in said arcuate path, the ankle of said user's foot travels in a path which is entirely outside of said arcuate path;*

*first and second track supported by the front end of said frame in an inclined relationship with the floor, each track being operative to engage and guide the second end of a respective one of said foot links along a respective, back and forth path of travel as the first end thereof travels in said arcuate path.*

* * * * *